US006864623B2

(12) United States Patent
Ishikawa

(10) Patent No.: US 6,864,623 B2
(45) Date of Patent: Mar. 8, 2005

(54) SPARK PLUG

(75) Inventor: Masahiro Ishikawa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 49 days.

(21) Appl. No.: 10/619,595

(22) Filed: Jul. 16, 2003

(65) Prior Publication Data

US 2004/0012318 A1 Jan. 22, 2004

(30) Foreign Application Priority Data

Jul. 16, 2002 (JP) ..... 2002-206692

(51) Int. Cl.[7] ..... H01T 13/20
(52) U.S. Cl. ..... 313/141
(58) Field of Search ..... 313/118, 135, 313/139, 141, 144

(56) References Cited

FOREIGN PATENT DOCUMENTS

JP 59-37684 A 3/1984

*Primary Examiner*—Vip Patel
(74) *Attorney, Agent, or Firm*—Sughrue Mion, PLLC

(57) ABSTRACT

A front end portion of a center electrode 3 is a circular cylindrical center-electrode noble-metal ablation resistance portion 31 whose radius r mm and length l mm are determined so as to satisfy $5 \leqq l/r^2 < 20$. An ignition-performance-improving ground electrode 4 is configured such that a distal end portion thereof is bent in a direction toward the center electrode 3; and a rear end-edge 32*t* of a distal end surface 4*s*, 32*s* is located frontward in relation to a front end surface 31*a* of the center-electrode noble-metal ablation resistance portion 31. In orthogonal projection on a projection plane P perpendicularly intersecting an axis O of the center electrode 3, the rear end-edge 32*t* is located outward in relation to the front end surface 31*a* of the center-electrode noble-metal ablation resistance portion 31. A portion of the ignition-performance-improving ground electrode 4 which includes at least the rear end-edge 32*t* is a ground-electrode noble-metal ablation resistance portion 32.

4 Claims, 11 Drawing Sheets

| | OUTSIDE ELECTRODE LENGTH (L) | RESONANCE FREQUENCY | DISTAL-END TEMPERATURE |
|---|---|---|---|
| ① | 9. 5mm | 18. 0 kHz | 850℃ |
| ② | 12. 0mm | 13. 9 kHz | 900℃ |

SPARK PLUG

BACKGROUND OF THE INVENTION

1. Field of the Invention

The present invention relates to a spark plug used for providing ignition in an internal combustion engine.

2. Description of the Related Art

Conventionally, in order to enhance ignition performance of a spark plug, a method has been proposed in which a groove is formed on a surface of a center electrode or a surface of a ground electrode which faces a spark discharge gap. By employing a groove, a flame nucleus generated by ignition of an air-fuel mixture induced by spark discharge can grow greatly in volume at the groove portion before contact with the electrode, thereby alleviating a cooling action (flame-extinguishing action) which is exerted by the electrode. As a result, ignition performance is enhanced, thereby preventing misfire and impairment in combustion.

In recent years, calls for global environmental protection have been growing. Under these circumstances, stronger energy conservation, $CO_2$ effluent control, and emission limitation on unburnt gas (hydrocarbon compounds) have been required. In order to meet such demands, automakers have been actively developing lean burn engines, direct-injection gasoline engines, low-emission engines, and the like. Furthermore, a lean burn engine has actively introduced therein an exhaust gas recirculation (EGR) system in which a portion of exhaust gas is recirculated into a combustion chamber so as to reduce negative workload to be done by the engine at the intake stroke, as well as to clean exhaust gas. In such applications, a spark plug must ignite an air-fuel mixture which is lean and contains a large amount of exhaust gas, which is an inert gas. Therefore, the above-mentioned conventional measures can no longer sufficiently cope with such applications.

Another technique for improving ignition performance of a spark plug is disclosed in Japanese Patent Application Laid-Open (kokai) No. S59-37684. Specifically, a distal end corner portion of a ground electrode faces a distal end corner portion of a center electrode in a positional relation so as to form a relatively large angle with respect to the axis of the center electrode; i.e., obliquely. This patent publication describes that sparking in such a direction as to intersect the axis of the center electrode improves ignition performance. Japanese Patent Application Laid-Open (kokai) No. S62-43090 or Japanese Utility Model Application Laid-Open (kokai) No. S58-74788 also discloses a spark plug in which a distal end of a ground electrode obliquely faces the corner of a distal end portion of a center electrode.

3. Problems Solved by the Invention

However, the spark plugs disclosed in the above-mentioned patent publications have the following problems.

(1) Since these spark plugs are configured such that the distal end of a ground electrode faces the corner of the distal end of a center electrode, a corner portion of the electrode is apt to be locally ablated. In order to further enhance ignition property, the spark plug disclosed in Japanese Patent Application Laid-Open (kokai) No. S59-37684 or Japanese Utility Model Application Laid-Open (kokai) No. S58-74788 is configured such that a distal end portion of a center electrode, together with a distal end portion of an insulator, protrudes from the end surface of a metallic shell. Such a spark plug exhibits a marked increase in electrode temperature, since the position of a spark discharge gap is located closer to a central portion of a combustion chamber, which assumes a higher temperature. Lean burn engines, direct-injection engines, and the like exhibit higher combustion temperature. Therefore, the above-mentioned electrode ablation at an edge portion is apt to proceed to a greater extent, thereby raising a problem that electrode life tends to expire earlier than in the case of an ordinary spark plug.

(2) In the spark plugs disclosed in the above-mentioned patent publications, a corner portion of the distal end of a center electrode and a corner portion of the distal end of a ground electrode are arranged such that their facing direction forms a relatively large angle with respect to the axis of the center electrode. Studies conducted by the present inventors have revealed that a spark plug of such configuration fails to yield the effect of enhancing ignition performance to such a marked degree as expected.

SUMMARY OF THE INVENTION

It is therefore a first object of the present invention to provide a spark plug capable of improving ignition performance, effectively suppressing local electrode ablation, and extending life thereof when used in a lean burn engine, when used with an EGR system, or when used in a like application. A second object of the present invention is to provide a spark plug capable of ensuring more improved ignition performance when used in a lean burn engine, when used with an EGR system, or when used in a like application.

The first object of the present invention has been achieved by providing a first spark plug characterized by comprising a tubular metallic shell; an insulator disposed in the metallic shell such that a distal end portion thereof protrudes from an end surface of the metallic shell; a center electrode disposed in the insulator such that a distal end portion thereof protrudes from an end surface of the insulator; and a ground electrode whose proximal end is joined to the end surface of the metallic shell and whose distal end portion faces a distal end portion of the center electrode to thereby form a spark discharge gap. The first spark plug is further characterized in that, when a side toward the spark discharge gap along the direction of an axis of the center electrode is defined as a front side,

- a front end portion of the center electrode is a circular cylindrical center-electrode noble-metal ablation resistance portion whose radius r (mm) and length l (mm) are determined so as to satisfy $5 \leqq l/r^2 < 20$;
- the ground electrode is an ignition-performance-improving ground electrode in which a distal end portion thereof is bent in a direction toward the center electrode; a rear end-edge of a distal end surface is located frontward in relation to a front end surface of the center-electrode noble-metal ablation resistance portion; and, in orthogonal projection on a projection plane perpendicularly intersecting the axis, the rear end-edge is located outward in relation to the front end surface of the center-electrode noble-metal ablation resistance portion; and
- a portion of the ignition-performance-improving ground electrode which includes at least the rear end-edge is a ground-electrode noble-metal ablation resistance portion.

The above-described first spark plug of the present invention presupposes that, in order to enhance ignition performance, a distal end portion of the insulator and a distal end portion of the center electrode protrude from the end surface of the metallic shell. One or more ground electrodes can be disposed around the center electrode. However, only one of the ground electrodes is an ignition-performance-improving ground electrode in which a distal end portion thereof is bent in a direction toward the center electrode; a rear end-edge of a distal end surface is located frontward in relation to a front end surface of the center-electrode noble-metal ablation resistance portion; and, in orthogonal projection on a projection plane perpendicularly intersecting the axis, the rear end-edge is located outward in relation to the front end surface of the center-electrode noble-metal ablation resistance portion. That is, as viewed in the above-mentioned orthogonal projection, the ignition-performance-improving ground electrode is disposed in such a positional relation with the front end surface of the center electrode so as not to overlap with the front end surface. The spark plugs of the present invention, including a second spark plug of the present invention to be described below, can employ either a configuration in which the ignition-performance-improving ground electrode is provided as the only ground electrode, or a configuration in which a plurality of ground electrodes consisting of one ignition-performance-improving ground electrode and one or more ground electrodes not assuming the form of an ignition-performance-improving ground electrode are provided.

Spark discharge in a spark plug constitutes a type of shock wave. As schematically shown in FIG. 16, a flame nucleus of air-fuel mixture induced by spark discharge is experimentally known to grow at a higher rate along the direction of a spark discharge path than along a direction perpendicular to the spark discharge path. Therefore, reducing, to the greatest possible extent, the degree of presence of an obstacle in the growth direction of the flame nucleus is advantageous in terms of enhancing ignition performance of an internal combustion engine. As shown in the left portion of FIG. 17, when, in the above-mentioned orthogonal projection, the ground electrode and the front end surface of the center electrode overlap each other, an overlapping distal end portion of the ground electrode becomes an obstacle to growth of the flame nucleus. As shown in the right portion of FIG. 17, since the ignition-performance-improving ground electrode used in the spark plug of the present invention does not involve the above-mentioned overlap with the front end surface of the center electrode, a distal end portion of the ground electrode is unlikely to function as the above-mentioned obstacle. Hence, flame grows swiftly outward of the ground electrode. This feature and the effect of protrusion of distal end portions of the insulator and the center electrode from the end surface of the metallic shell combine to markedly enhance ignition performance. Also, even when two or more ground electrodes are provided, the above-mentioned ignition-performance-improving ground electrode is the only ground electrode configured such that the rear end-edge of the distal end surface is located frontward in relation to the front end surface of the center-electrode noble-metal ablation resistance portion. Therefore, the growth of flame generated across the spark discharge gap formed partially by the ignition-performance-improving ground electrode is not hindered by flame-extinguishing action of the other ground electrode(s).

Meanwhile, the above-mentioned protrusion of the insulator and the center electrode unavoidably involves a significant increase in electrode temperature, particularly in application to a lean burn engine, a direct-injection engine, or the like. Since the ignition-performance-improving ground electrode and the center electrode are disposed so as not to overlap each other, their corner portions face each other with the spark discharge gap present therebetween. Therefore, even when a noble-metal ablation resistance portion is provided on each of the ignition-performance-improving ground electrode and the center electrode, the corner portions are still susceptible to local electrode ablation. Particularly, the edge portion of the center electrode whose discharge polarity is often set to negative is susceptible to ablation. In order to cope with this problem, in the first spark plug of the present invention, the radius r and the length l of the circular cylindrical center-electrode noble-metal ablation resistance portion serving as a front end portion of the center electrode are determined so as to satisfy the relation $5 \leqq l/r^2 \leqq 20$, which is specific to the present invention. By determining the dimensions of the center-electrode noble-metal ablation resistance portion in this manner, the temperature rise is reduced, and electrode ablation at the corner portion that faces the spark discharge gap can be suppressed very effectively.

When $l/r^2$ is less than 5, the center-electrode noble-metal ablation resistance portion encounters difficulty in increasing in temperature, thereby failing to produce a marked enhancement in ignition performance. Also, a reduction in discharge voltage cannot be expected. When $l/r^2$ is in excess of 20, temperature rise becomes significant, and thus electrode ablation is prone to accelerate, resulting in a failure to attain sufficiently long life.

In the above-described first spark plug of the present invention, preferably, as viewed in orthogonal projection on a projection plane in parallel with a plane which includes the axis and a geometric barycenter position of a section of the ignition-performance-improving ground electrode cut at a position located 1 mm forward from the end surface of the metallic shell by a plane perpendicularly intersecting the axis, and on condition that, on the projection plane, an end edge position of the distal end surface of the center electrode, the end edge position being closer to the rear end-edge of the ignition-performance-improving ground electrode than the other end edge position, is defined as an origin; an x-axis is defined as extending through the origin in parallel with the distal end surface of the center electrode such that a side corresponding to the position of the ignition-performance-improving ground electrode is positive in polarity; and a y-axis is defined as extending through the origin in parallel with the axis such that a side corresponding to the position of the spark discharge gap is positive in polarity, coordinates (x, y) (unit of length: mm) of the rear end-edge of the ignition-performance-improving ground electrode are determined so as to satisfy $$1.6 \geqq y \geqq 0.4;$$

$$x > 0; \text{ and}$$

$$y \geqq (\mathrm{Tan}^{-1}\ 16^\circ)x.$$

A second spark plug of the present invention is characterized by comprising a center electrode, a metallic shell disposed so as to surround a circumferential side surface of the center electrode, and a ground electrode whose proximal end is joined to an end surface of the metallic shell and which forms a spark discharge gap between the same and the center electrode, and is further characterized in that:

when a side toward the spark discharge gap along the direction of an axis of the center electrode is defined as a front side, the ground electrode is an ignition-performance-improving ground electrode in which a distal end portion thereof is bent in a direction toward the center electrode; a rear end-edge of a distal end surface is located frontward in relation to a front end surface of the center-electrode noble-metal ablation resistance portion; and, in orthogonal projection on a projection plane perpendicularly intersecting the axis, the rear end-edge is located outward in relation to the front end surface of the center-electrode noble-metal ablation resistance portion; and as viewed in orthogonal projection on a projection plane in parallel with a plane which includes the axis and a geometric barycenter position of a section of the ignition-performance-improving ground electrode cut at a position located 1 mm forward from the end surface of the metallic shell by a plane perpendicularly intersecting the axis, and on condition that, on the projection plane, an end edge position of the distal end surface of the center electrode, the end edge position being closer to the rear end-edge of the ignition-performance-improving ground electrode than the other end edge position, is defined as an origin; an x-axis is defined as extending through the origin in parallel with the distal end surface of the center electrode such that a side corresponding to the position of the ignition-performance-improving ground electrode is positive in polarity; and a y-axis is defined as extending through the origin in parallel with the axis such that a side corresponding to the position of the spark discharge gap is positive in polarity, coordinates (x, y) (unit of length: mm) of the rear end-edge of the ignition-performance-improving ground electrode are determined so as to satisfy $$1.6 \geqq y \geqq 0.4 \quad (1);$$

$$x > 0 \quad (2);$$

$$y \geqq (\mathrm{Tan}^{-1}\ 16°)x \quad (3).$$

In the above-described configuration, the relational expression (3) is particularly important. FIG. 21 schematically shows orthogonal projection on the above-mentioned projection plane. As is apparent from the drawing, the relational expression (3) prescribes that the angle θ between the axis (O: whose direction coincides with the direction of the y-axis) of the center electrode and the facing direction CD between the rear end-edge (32*t*: a corner portion of the ground electrode which faces the spark discharge gap) of the end surface of the ignition-performance-improving ground electrode and the end edge position (31*t*: a corner portion of the center electrode which faces the spark discharge gap) of the front end surface of the center electrode, the end edge position being closer to the rear end-edge of the ignition-performance-improving ground electrode-than the other end edge position, be 16° or less (a side corresponding to the ground electrode with respect to the y-axis is positive in polarity). From the condition specified by the expression (2), the angle θ excludes 0° and does not assume a negative value.

The above-described second spark plug of the present invention is qualitatively similar to the spark plug disclosed in Japanese Patent Application Laid-Open (kokai) No. S59-37684 or S62-43090 in terms of the positional relation between the distal end surface of the ground electrode and the distal end surface of the center electrode. The range of the angle θ is not specified for the spark plugs disclosed in these patent publications. However, detailed studies of these patent publications have revealed the following. Since the claim for a spark plug of Japanese Patent Application Laid-Open (kokai) No. S59-37684 states "to form a spark discharge gap which is directed in a direction crossing the axis of a center electrode," the gist of this spark plug is to positively incline, with respect to the axis (O) of the center electrode, the gap formation direction; i.e., the facing direction CD between the ground electrode corner 32*t* and the center electrode corner 31*t*, thereby enhancing ignition performance. The angle θ as read from FIG. 3 of the patent publication is presumed to be about 33°. In the case of the spark plug disclosed in Japanese Patent Application Laid-Open (kokai) No. S62-43090, the angle θ as read from, for example, FIG. 1 or 2 of the patent publication is about 35°. The angle θ as read from FIG. 1 of Japanese Utility Model Application Laid-Open (kokai) No. S58-74788 is about 27°. The angle θ as read from these patent publications is considerably greater than the upper limit 16° specified in the second spark plug of the present invention.

Studies conducted by the present inventors have revealed that, when the angle θ is increased as mentioned above, the effect of enhancing ignition performance of a spark plug is not obtained to such a marked degree as expected. Subsequent detailed studies conducted by the present inventors have revealed that, when the angle θ assumes a value of 16° or less; i.e., when the facing direction CD between the ignition-performance-improving ground electrode corner 32*t* and the center electrode corner 31*t* is brought as close as possible to the direction of the axis (O) of the center electrode, the effect of enhancing ignition performance of a spark plug is obtained to a considerably marked degree. Thus is completed the second spark plug of the present invention.

As shown in FIG. 15, the distribution of air-fuel mixture within a combustion chamber is uneven; specifically, air-fuel mixture becomes rich toward the center of the combustion chamber as shown by a contour line (CR) of air-fuel mixture. The spark plug 100 is located at the lean gas mixture side in the combustion chamber. This tendency is particularly marked in a direct-injection engine, but also possibly arises in the case of uniform mixture attained through injection into an intake pipe. In either case, the preferential growth direction of a flame nucleus which is described previously with reference to FIG. 16; i.e., the direction of the spark discharge path in the spark discharge gap, being directed toward the center of a combustion chamber (i.e., the direction coinciding with the axis of the center electrode) is advantageous in terms of enhancing ignition performance. In the second spark plug of the present invention, the direction of the spark discharge path is the facing direction CD between the ignition-performance-improving ground electrode corner 32*t* and the center-electrode corner 31*t*; and the facing direction CD coincides with the axis of the center electrode (i.e., θ=0), or, even when the facing direction CD intersects the axis at angle θ, the angle θ assumes a small value of 16° or less. Thus, further improved ignition performance is ensured; i.e., the second object of the present invention is achieved.

When $y < (\mathrm{Tan}^{-1}\ 16°)x$; i.e., when θ is in excess of 16°, sufficient ignition performance cannot be ensured. When $x \leqq 0$; i.e., when θ assumes 0° or a negative value, sufficient ignition performance cannot be ensured. When $1.6 < y$, the spark discharge gap becomes too large, and thus discharge voltage becomes excessively high, thereby disabling discharge. When $y < 0.4$, tolerance to which the gap must be formed in manufacture becomes excessively narrow, thereby leading to impaired yield. Also, adhesion of electrically conductive foreign matter such as a fouling substance tends to cause a short circuit across the gap.

Figure 1:
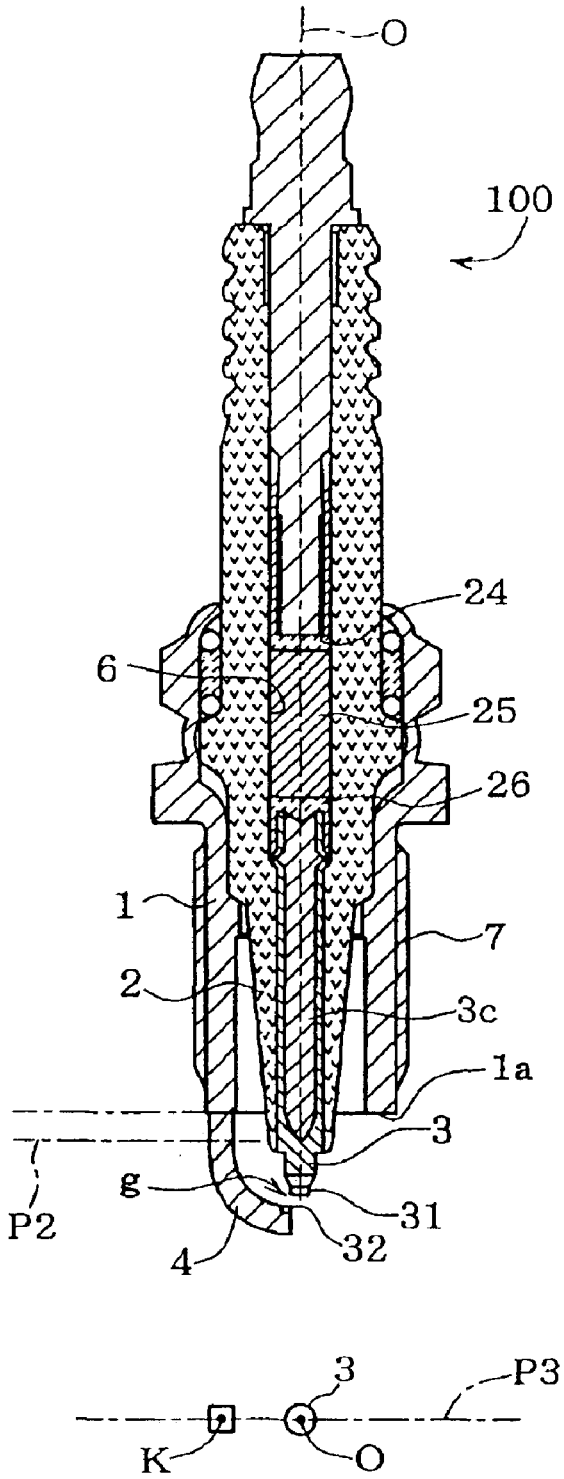
FIG. 1 is a vertical sectional view showing an embodiment of the spark plug of the present invention.

Reference numerals are used to identify items shown in the drawings as follows:

1: metallic shell
2: insulator
3: center electrode
g: spark discharge gap
4: ignition-performance-improving ground electrode
4*f*: rear end-edge
4*m*: electrode body
4*s*: formed surface
5: semi-creepage ground electrode
31: center-electrode noble-metal ablation resistance portion
31*a*: front end surface
32: ground-electrode noble-metal ablation resistance portion
32*s*: formed surface

DESCRIPTION OF THE PREFERRED EMBODIMENTS

Embodiments of the present invention will next be described by way of non-limiting example only with reference to the accompanying drawings.

FIG. 1 shows a spark plug 100 according to an embodiment of the present invention. The spark plug 100 includes a tubular metallic shell 1; an insulator 2 disposed in the metallic shell 1 such that a distal end portion thereof protrudes from the end surface of the metallic shell 1; a center electrode 3 disposed in the insulator 2 such that a distal end portion thereof protrudes from the end surface of the insulator 2; and a ground electrode 4 whose proximal end is joined to the end surface of the metallic shell 1 and whose distal end portion faces a distal end portion of the center electrode 3 to thereby form a spark discharge gap g. The center electrode 3 is disposed at the front end (a side toward the spark discharge gap along the direction of the axis O is defined as a front side) of a through-hole 6 formed in the insulator 2 in such a manner as to extend along the direction of the axis O. A metallic terminal member 23 is disposed at the rear end of the through-hole 6 and is electrically connected to the center electrode 3 via electrically conductive glass seal layers 24 and 26 and a radio-wave-absorbing resistor 25. The insulator 2 is formed from, for example, an alumina or aluminum nitride ceramic sintered body. The metallic shell 1 is formed from a metal such as low-carbon steel and has a male-threaded portion 7 formed on its outer circumferential surface and adapted to mount the plug 100 to an unillustrated engine block.

Figure 2:
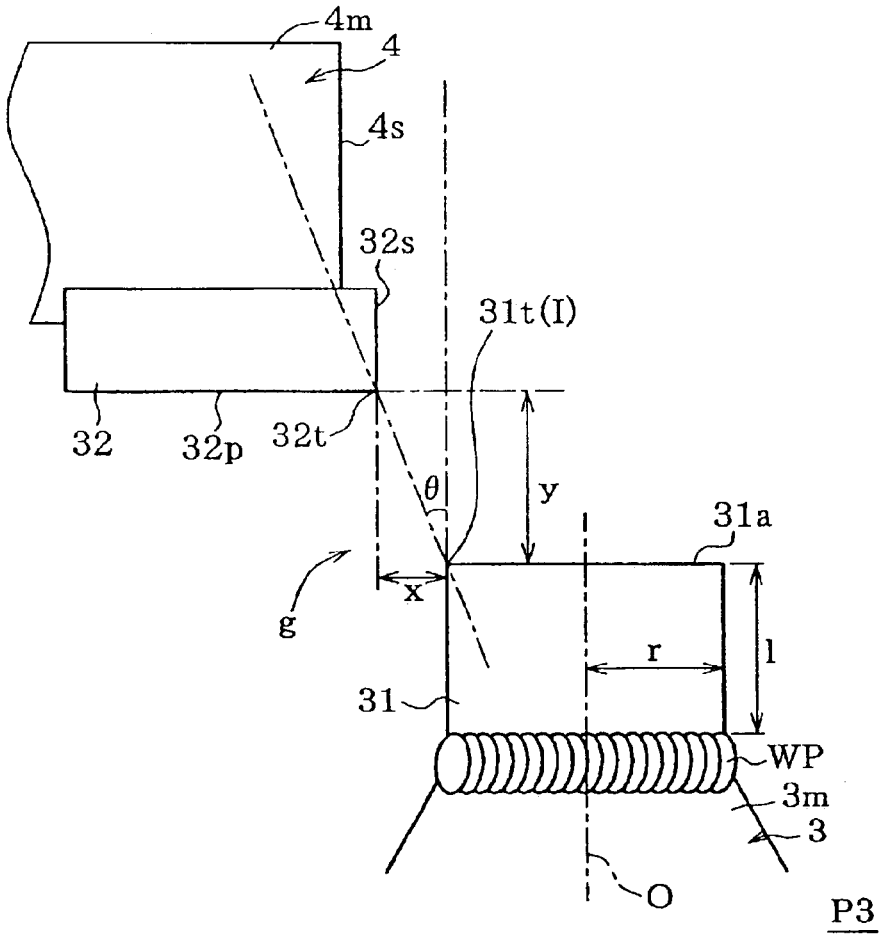
FIG. 2 is an enlarged schematic view showing a main portion of FIG. 1 by means of orthogonal projection on projection plane P3.

FIG. 2 is an enlarged view showing a main portion of the spark plug 100. Hereinafter, a side toward the spark discharge gap g along the direction of the axis O of the center electrode 3 is defined as a front side. A front end portion of the center electrode 3 is a circular cylindrical center-electrode noble-metal ablation resistance portion 31 whose radius r (mm) and length l (mm) are determined so as to satisfy $5 \leqq l/r^2 < 20$. The center-electrode noble-metal ablation resistance portion 31 is formed in the following manner: a circular cylindrical noble-metal chip is superposed on the front end surface of an electrode body 3*m*-which includes at least a surface layer portion formed from an Ni alloy such as INCONEL 600 (trademark)-and is joined to the electrode body 3*m* through formation of a laser weld portion WP along the outer circumferential edge of the superposition surface. In the present embodiment, as shown in FIG. 1, a heat release acceleration portion 3*c* formed from Cu or a copper alloy is embedded in the electrode body 3*m* in order to accelerate heat release from the electrode. Notably, the radius r of the center-electrode noble-metal ablation resistance portion 31 is the radius of a front end surface 31*a*; and the length l is a distance, as measured along the direction of the axis (O), between the front end surface 31*a* and a front end edge position of the laser weld portion WP in the direction of the axis (O).

Figure 4:
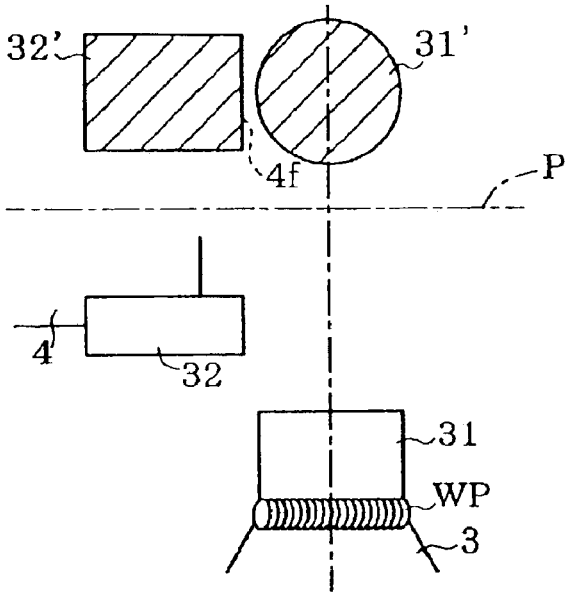
FIG. 4 is an explanatory view showing the positional relationship between the ignition-performance-improving ground electrode and the center-electrode noble-metal ablation resistance portion.

The spark plug 100 has only one ground electrode 4. The ground electrode 4 is an ignition-performance-improving ground electrode 4 in which a distal end portion thereof is bent in a direction toward the center electrode 3; a rear end-edge 32*t* of a distal end surface 4*s*, 32*s* is located frontward in relation to the front end surface 31*a* of the center-electrode noble-metal ablation resistance portion 31; and, as shown in FIG. 4, in orthogonal projection on a projection plane P perpendicularly intersecting the axis O (where 31' is the orthogonal projection of 31, and 32' is the orthogonal projection of 32), the rear end-edge 4*f* is located outward in relation to the front end surface 31*a* of the center-electrode noble-metal ablation resistance portion 31. Also, a portion of the ignition-performance-improving ground electrode 4 which includes the rear end-edge 4*f* is a ground-electrode noble-metal ablation resistance portion 32. Notably, the noble-metal ablation resistance portions 31 and 32 are formed from, for example, Pt, Ir, or an alloy which contains Pt or Ir as a main component (a component of highest content).

Figure 17:
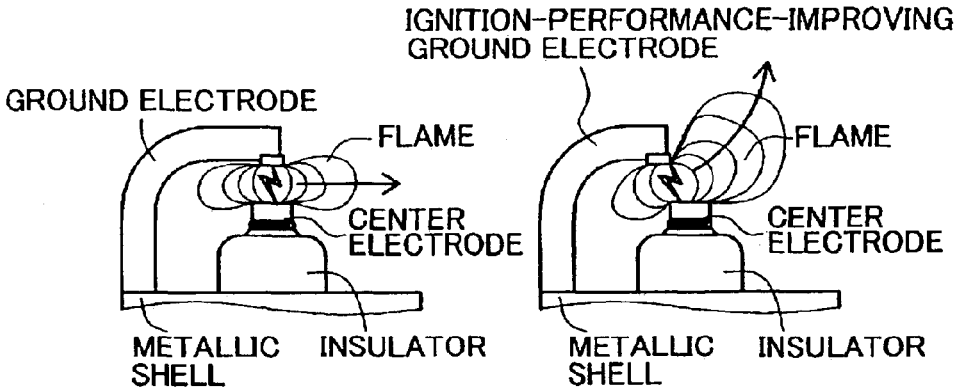
FIG. 17 is a view illustrating the action of the spark plug of the present invention through comparison with that of a conventional spark plug.

By providing the ignition-performance-improving ground electrode 4 in the above-described arrangement relation, as described previously with reference to FIG. 17 (right-hand view), a distal end portion of the ground electrode is unlikely to function as an obstacle to growth of flame. This feature and the effect of protrusion of the distal end portions of the insulator 2 and the center electrode 3 from the end surface of the metallic shell 1 combine to markedly enhance ignition performance. Since the ignition-performance-improving ground electrode 4 is provided as the only ground electrode 4, the growth of flame is not hindered by flame-extinguishing action of another ground electrode.

Referring back to FIG. 1, since the above-described spark plug 100 is configured such that the insulator 2 and the center electrode 3 protrude from the end surface 1*a* of the metallic shell 1, electrode temperature increases considerably in application to a lean burn engine, a direct-injection engine, or the like. As shown in FIG. 2, since the ignition-performance-improving ground electrode 4 and the center electrode 3 are disposed so as not to overlap each other, the ground electrode corner (rear end-edge) 32*t* and the center electrode corner 31*t* face each other with the spark discharge gap g present therebetween. Therefore, even though the noble-metal ablation resistance portions 32 and 31 are provided on the ignition-performance-improving ground electrode 4 and the center electrode 3, respectively, the corners 32*t* and 31*t* are still susceptible to local electrode ablation. The corner 31*t* of the center electrode whose discharge polarity is often set to negative is particularly susceptible ablation. In order to cope with this problem, in the above-described spark plug 100, the radius r and the length l of the center-electrode noble-metal ablation resistance portion 31 are determined so as to satisfy the relation $5 \leqq l/r^2 \leqq 20$. By determining the dimensions of the center-electrode noble-metal ablation resistance portion 31 in this manner, temperature rise is reduced, and electrode ablation at the corner 31*t* can be suppressed very effectively.

Next, in FIG. 1, K represents the geometric barycenter position of a section of the ignition-performance-improving ground electrode 4 cut at a position located 1 mm forward from the end surface 1*a* of the metallic shell 1 by a plane P2 perpendicularly intersecting the axis O. As viewed in orthogonal projection on a projection plane P3 in parallel with a plane which includes the geometric barycenter position K and the axis O, an origin I is defined on the projection plane P3, as shown in FIG. 2, as an end edge position of the distal end surface 31*a* of the center electrode 3, the end edge position being closer to the rear end-edge 32*t* of the ignition-performance-improving ground electrode 4 than the other end edge position. An x-axis is defined as extending through the origin I in parallel with the distal end surface 31*a* of the center electrode 3 such that the side corresponding to the position of the ignition-performance-improving ground electrode 4 is positive in polarity; and a y-axis is defined as extending through the origin I in parallel with the axis O such that the side corresponding to the position of the spark discharge gap g is positive in polarity. Coordinates (x, y) (unit of length: mm) of the rear end-edge 32*t* of the ignition-performance-improving ground electrode 4 are determined so as to satisfy the following:

$$1.6 \geqq y \geqq 0.4 \quad (1)$$

$$x > 0 \quad (2)$$

$$y \geqq (\mathrm{Tan}^{-1}\ 16^\circ)x \quad (3)$$

The expression (3) prescribes that the angle θ between the axis O of the center electrode 3 and the facing direction CD between the corner (rear end-edge) 32*t* of the ignition-performance-improving ground electrode 4 and the corner (end edge position of the front end surface 31*a*) 31*t* be 16° or less. From the condition specified by the expression (2), the angle θ excludes 0° and does not assume a negative value. By employing a small angle θ equal to 16° or less, the effect of enhancing ignition performance of a spark plug is obtained to a considerably marked degree.

Figure 5A:
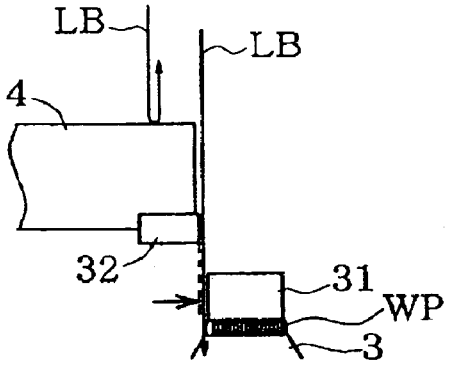
FIG. 5A illustrates action in the case where a gap is formed between the ignition-performance-improving ground electrode and the center-electrode noble-metal ablation resistance portion.
Figure 5B:
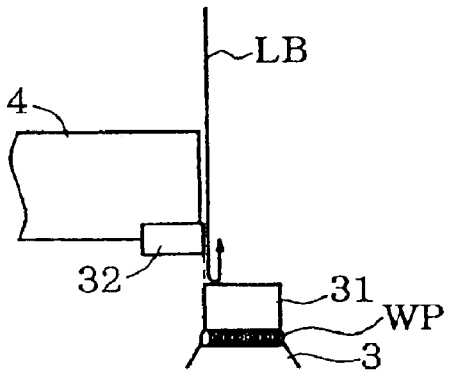
FIG. 5B is a view showing a problem involved in the case where the gap in FIG. 5A is not formed.

The aforementioned x value is preferably set to 0.05 mm or greater. This means that a gap of 0.05 mm or greater is formed along the x direction between the front end surface 31*a* of the center electrode 3 and the distal end surface of the ground electrode 4. As shown in FIG. 5A, whether or not a gap of a significant size is formed between the front end surface 31*a* of the center electrode 3 and the distal end surface of the ground electrode 4 can immediately be checked by observing information about reflection of a laser beam LB which is radiated along the direction of the axis O while its radiation position is being changed. However, if an x value less than 0.05 mm is accepted, spark plug products in which the gap is actually zero will be produced in large quantity in view of dimensional tolerance, thereby disabling acceptance-rejection judgment. In this case, inspection of a spark plug by use of projection as shown in FIG. 2 enables reliable detection of the x value. However, this method requires precision analysis of a projected image, thus unavoidably involving impaired inspection efficiency. Thus, when the x value is set to 0.05 mm or greater as mentioned above, the above-mentioned gap can be imparted to conforming products substantially without fail even though dimensional tolerance and an error of gap adjustment by an ordinary method are taken into account. In other words, a spark plug which exhibits no reflection information corresponding to the gap can immediately be judged defective.

Next, as shown in FIG. 2, the ignition-performance-improving ground electrode 4 includes an electrode body 4*m* in which at least a surface layer portion is formed form an Ni alloy such as INCONEL 600, and a noble metal chip 32 which is joined to the electrode body 4*m* at a position facing the spark discharge gap g and serves as a ground-electrode noble-metal ablation resistance portion. As viewed in orthogonal projection on the projection plane P3, only a certain portion, including the rear end-edge 32*t*, of the distal end surface 4*s*, 32*s* of the ignition-performance-improving ground electrode 4 is constituted by a surface 32*s* formed by the noble metal chip 32. This structure enables formation of a ground-electrode noble-metal ablation resistance portion merely through joining, by means of, for example, resistance-welding, a small, plate-like noble metal chip 32 to the electrode body 4*m* at a corner facing the spark discharge gap g; i.e., at a position corresponding to the rear end-edge. As compared with the spark plug disclosed in Japanese Patent Application Laid-Open (kokai) No. S62-43090 in which the entire distal end portion of the ground electrode is a noble-metal ablation resistance portion, noble-metal usage can be considerably reduced.

Figure 3:
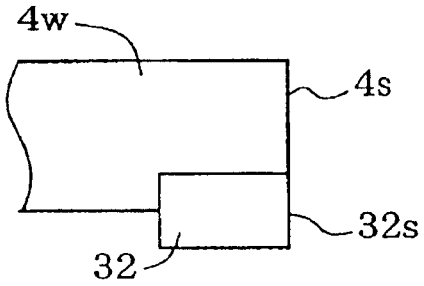
FIG. 3 is an enlarged schematic view showing a first modified embodiment of the manner of formation of the ground-electrode noble-metal ablation resistance portion.

As shown in FIG. 3, the distal end surface 4*s*, 32*s* of the ignition-performance-improving ground electrode 4 can be formed such that the surface 32*s* formed by the noble metal chip 32 and the surface 4*s* formed by the electrode body 4*m* and constituting the residual portion of the distal end surface are substantially flush with each other. However, as shown in FIG. 2, through protruding the surface 32*s* formed by the noble metal chip 32 toward the axis O, electrode ablation at the corner facing the spark discharge gap g; i.e., at the rear end-edge 32*t*, can be markedly suppressed.

According to the configuration of FIG. 2, on the projection plane P3, a chip surface (i.e., a chip surface facing the spark discharge gap g) 32*p* of the noble metal chip 32 which extends from the rear end-edge 32*t* toward a side corresponding to the proximal end of the ignition-performance-improving ground electrode 4 is in parallel with the front end surface 31*a* of the center-electrode noble-metal ablation resistance portion 31. As in the case of the spark plug disclosed in Japanese Patent Application Laid-Open (kokai) No. S62-43090, when a surface of the ground-electrode noble-metal ablation resistance portion which faces the spark discharge gap g is inclined with respect to the front end surface of the center electrode, ablation at a corner of the ground-electrode noble-metal ablation resistance portion causes the spark discharge position to shift in an inclination direction, in which a gap associated with the surface decreases. As a result, the deviation of the direction of the discharge path from the axis O of the center electrode 3 increases, thereby impairing ignition performance. By contrast, in the spark plug 100 of the present invention, since the chip surface 32*p* is in parallel with the front end surface 31*a* of the center-electrode noble-metal ablation resistance portion 31, variation in the spark discharge position is small, whereby good ignition performance can be maintained at all times.

Various modified embodiments of the spark plug of the present invention will next be described.

Figure 6:
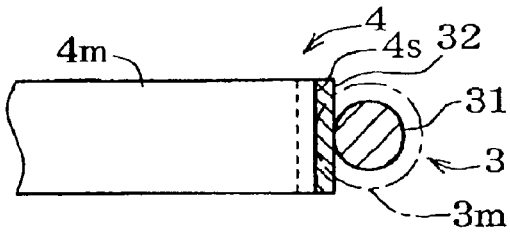
FIG. 6 is an enlarged schematic view showing a second modified embodiment of the manner of formation of the ground-electrode noble-metal ablation resistance portion.
Figure 7:
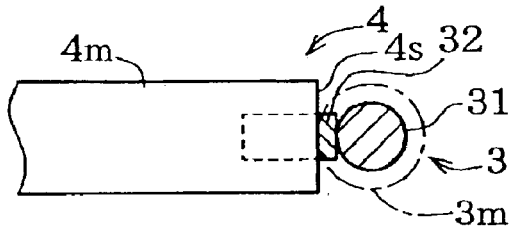
FIG. 7 is an enlarged schematic view showing a third modified embodiment of the manner of formation of the ground-electrode noble-metal ablation resistance portion.
Figure 8:
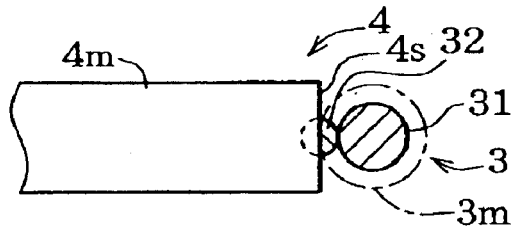
FIG. 8 is an enlarged schematic view showing a fourth modified embodiment of the manner of formation of the ground-electrode noble-metal ablation resistance portion.

The ground-electrode noble-metal ablation resistance portion 32 of the ignition-performance-improving ground electrode 4 can be embodied in various forms so long as a spark discharge gap can be formed between the same and the center-electrode noble-metal ablation resistance portion 31. FIG. 6 shows an embodiment in which the ground-electrode noble-metal ablation resistance portion 32 is formed by use of a noble metal chip extending across the entire width of the electrode body 4*m*. FIG. 7 shows an embodiment in which the ground-electrode noble-metal ablation resistance portion 32 is formed by joining a noble metal chip narrower than the electrode body 4*m* to the electrode body 4*m* at an intermediate position with respect to the width direction of the electrode body 4*m*. In FIGS. 6 and 7, the ground-electrode noble-metal ablation resistance portion 32 is formed by use of a quadrangular prismatic noble-metal chip. However, as shown in FIG. 8, the ground-electrode noble-metal ablation resistance portion 32 may be formed by use of a disklike noble metal chip.

Figure 9:
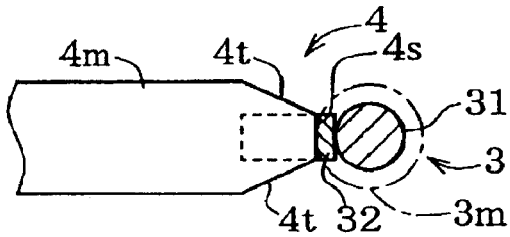
FIG. 9 is an enlarged schematic view showing a first modified embodiment of the electrode body of the ignition-performance-improving ground electrode.

FIG. 9 shows an embodiment in which two taper surfaces 4*t* are formed on opposite sides, with respect to the width direction, of a distal end portion of the electrode body 4*m*. This structural feature reduces the volume of the electrode distal-end portion, whereby the flame-extinguishing action of the electrode body 4*m* itself can be alleviated, and thus ignition performance can be more enhanced. Since the electrode distal-end portion is narrowed, discharge voltage is reduced, and a phenomenon in which fuel is held between the center electrode and the ground electrode; i.e., so-called bridge, becomes unlikely to occur.

Figure 10:
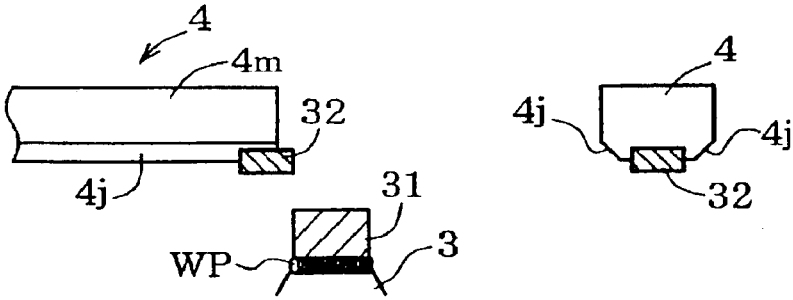
FIG. 10 is an enlarged schematic view showing a second modified embodiment of the electrode body of the ignition-performance-improving ground electrode.

FIG. 10 shows an embodiment in which the electrode body 4*m* has a cross section that is narrowed at a side toward the spark discharge gap g. In this embodiment, a cross section is narrowed at one side by use of two taper surfaces 4*j*, but may also be narrowed by use of radiused surfaces. This embodiment also effectively alleviates flame-extinguishing action through reduction in the volume of the electrode body 4*m*, and effectively suppresses occurrence of fuel bridge.

Figure 11:
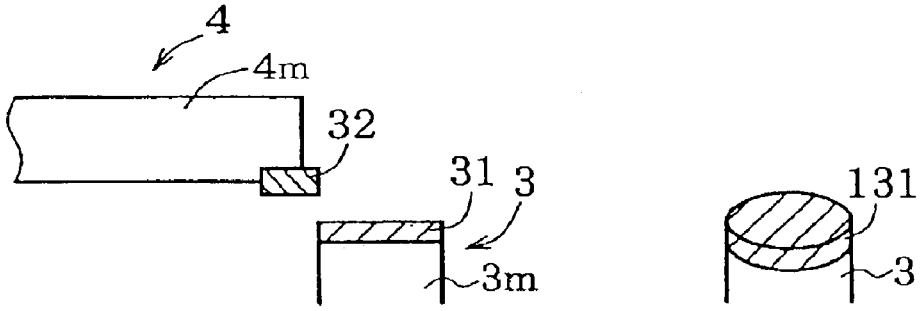
FIG. 11 is an enlarged schematic view showing a first modified embodiment of the manner of formation of the center-electrode noble-metal ablation resistance portion.
Figure 12:
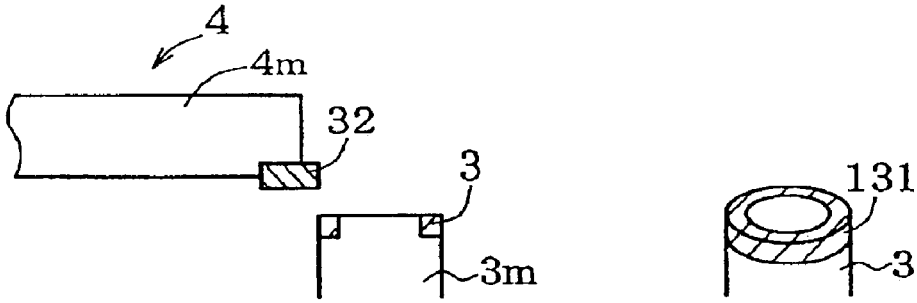
FIG. 12 is an enlarged schematic view showing a second modified embodiment of the manner of formation of the center-electrode noble-metal ablation resistance portion.

In FIG. 1 and FIGS. 6 to 9, the center-electrode noble-metal ablation resistance portion 31 is smaller in diameter than the electrode body 3*m*. However, as shown in FIG. 11, the electrode body 3*m* and the center-electrode noble-metal ablation resistance portion 31 can assume substantially the same diameter. However, the former exhibits better ignition performance. Also, as shown in FIG. 12, an annular center-electrode noble-metal ablation resistance portion 131 may be formed along the circumferential edge of the front end surface of the electrode body 3*m*.

Figure 13:
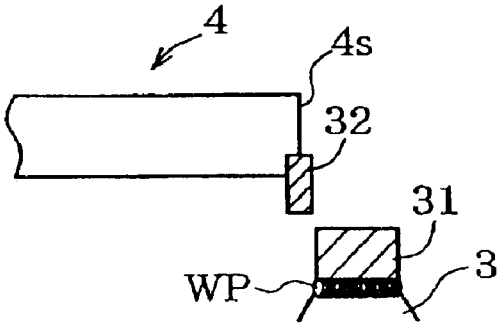
FIG. 13 is an enlarged schematic view showing a fifth modified embodiment of the manner of formation of the ground-electrode noble-metal ablation resistance portion.

In FIG. 2, the ground-electrode noble-metal ablation resistance portion 32 protrudes in a larger amount from the distal end surface 4*s* of the electrode body 4*m* than from the side surface of the electrode body 4*m* that faces the spark discharge gap g. However, FIG. 13 shows a modified embodiment in which the relation of the protrusion amount is reversed.

Figure 14:
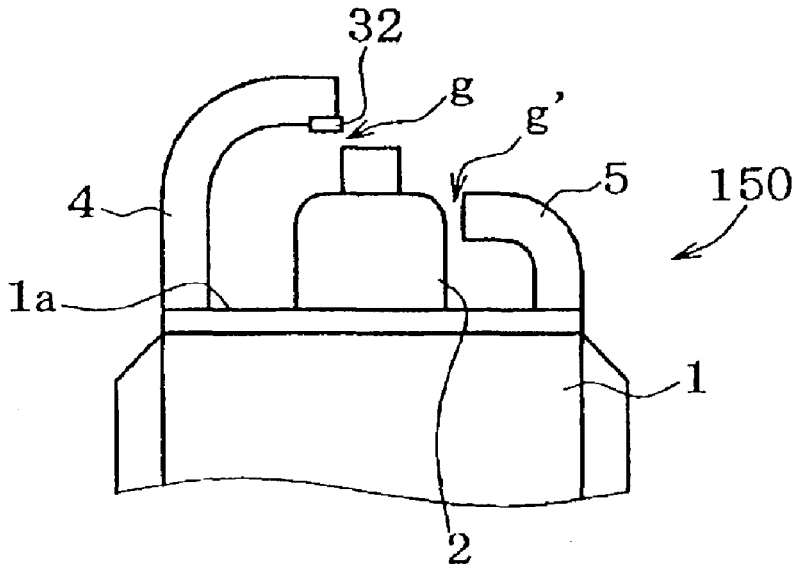
FIG. 14 is an enlarged view showing a main portion of a spark plug having a ground electrode in addition to an ignition-performance-improving ground electrode.
Figure 15:
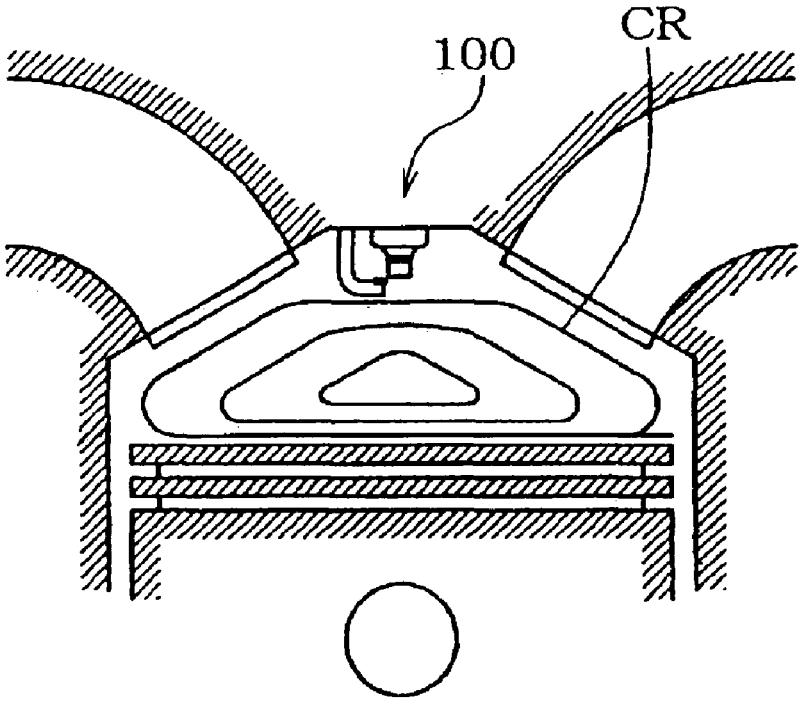
FIG. 15 is a view conceptually illustrating air-fuel ratio distribution within a combustion chamber.
Figure 16:
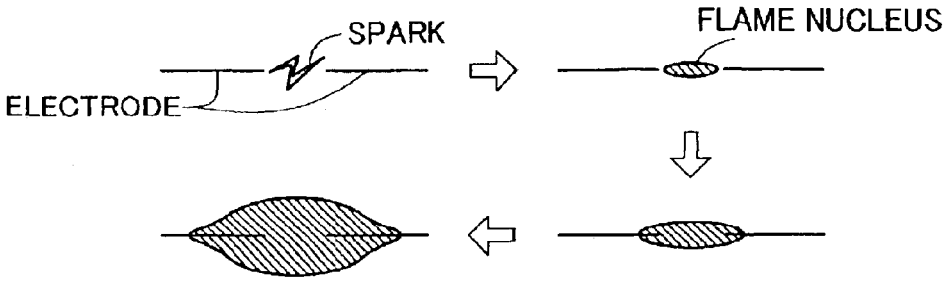
FIG. 16 is a view illustrating the relationship between a spark discharge direction and a growth direction of a flame nucleus.

FIG. 14 exemplifies a spark plug having a ground electrode in addition to the ignition-performance-improving ground electrode 4. This spark plug 150 has, in addition to the ignition-performance-improving ground electrode 4, a semi-creepage ground electrode 5 which faces the circumferential side surface of a front end portion of the insulator 2 protruding from the distal end surface 1*a* of the metallic shell 1 to thereby form a semi-creepage discharge gap g'. The semi-creepage discharge gap g' is narrower than the spark discharge gap g which is formed by the ignition-performance-improving ground electrode 4, and has a function for cleaning the front end portion of the insulator 2 by means of sparking when the portion is fouled. A plurality of semi-creepage ground electrode 5 may be provided.

EXAMPLES

The results of experiments conducted to verify the effect of the spark plug of the present invention will next be described.

Experimental Example 1

Spark plug samples of the present invention and comparative spark plug samples were manufactured such that the center-electrode noble-metal ablation resistance portion 31 formed from an Ir alloy had a length l of 0.8 mm and a diameter 2*r* of 1 mm or 3 mm. Among these samples, the comparative spark plug samples assumed a configuration such that the ground electrode 4 overlapped the front end surface 31*a* of the noble-metal ablation resistance portion 31 over the entire diameter of the front end surface 31*a*; and the spark plug samples of the present invention assumed a configuration such that x in FIG. 2 was set to 0.05 mm so as to avoid overlap. The front end surface 31*a* of the center-electrode noble-metal ablation resistance portion 31 was caused to protrude 3 mm from the front end surface 1*a* of the metallic shell 1. The spark discharge gap g had two kinds of gap (y) as measured along the direction of the axis O; specifically, 1.1 mm and 0.8 mm. The electrode body 4*m* of the ground electrode 4 had a width of 2.7 mm.

The above-described spark plug samples were mounted on a 6-cylinder gasoline engine having a total displacement of 2,000 cc. The engine was started at an engine speed of 700 rpm (corresponding to idling), a negative intake pressure of −540 mmHg, and an air-fuel ratio of intake air-fuel mixture of 14.1 (theoretical air-fuel ratio). Then, spark advance was gradually delayed until MBT (Minimum Spark Advance for Best Torque) was found. Subsequently, operation was continued with ignition timing fixed to the thus obtained MBT while the air-fuel ratio was gradually changed toward the lean side. An air-fuel ratio as measured when the variation percentage of average combustion pressure on the basis of an average combustion pressure at an air-fuel ratio of 14.1 reached 20% was obtained as critical air-fuel ratio. Table 1 shows the results.

TABLE 1

| Center Electrode | Comparative Example | Example | Degree of Improvement |
|---|---|---|---|
| 2r = 1.0 | 17.2/16.9 | 17.5/17.3 | 0.3/0.4 |
| 2r = 3.0 | 16.0/14.5 | 17.3/16.4 | 1.2/1.9 |

2r: center-electrode distal-end diameter (mm)
Left-hand value in each column: critical air-fuel ratio at a gap of 1.1 mm
Right-hand value in each column: critical air-fuel ratio at a gap of 0.8 mm The samples of the present invention exhibited higher critical air-fuel ratios than the comparative samples, indicating that they have good ignition performance. The greater the diameter 2*r* of the center-electrode front-end surface 31*a* or the smaller the spark discharge gap, the greater the degree of improvement of air-fuel ratio. From this point of view, in order to markedly yield the effect for improving ignition performance, preferably, the diameter 2*r* of the center-electrode front-end surface 31*a* is set to 0.4–2.2 mm, and the spark discharge gap is set to 0.3–1.1 mm.

Figure 19:
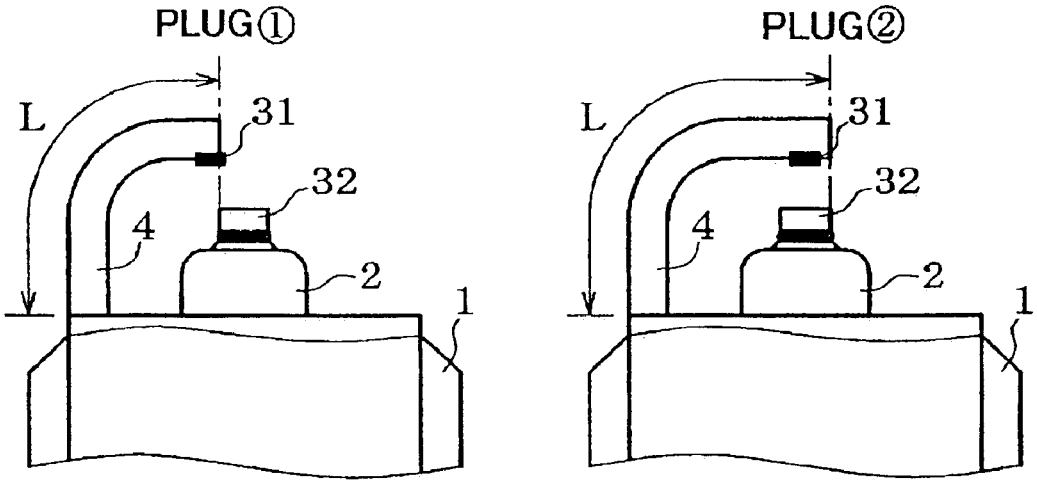
FIG. 19 is a graph showing a second group of results of Experimental Example 1.

As shown in FIG. 19, in the case of the samples in which the diameter 2*r* of the center-electrode noble-metal ablation resistance portion 31 was 1 mm, and the spark discharge gap g had a gap (y) of 1.1 mm as measured along the direction of the axis O, the comparative sample had a length L of the ground electrode 4 of 12 mm, whereas the sample of the present invention had a shorter length of the ground electrode 4 of 9.5 mm since the ground electrode 4 did not overlap the front end surface 31*a* of the center-electrode noble-metal ablation resistance portion 31. These samples were mounted on the same engine. The engine was operated at an engine speed of 5,000 rpm while the throttle was completely opened, and the temperature of distal end portions of the ground electrodes was measured by use of thermocouples. As shown in FIG. 19, the sample of the present invention exhibited a smaller degree of temperature rise and is thus advantageous in terms of durability against electrode ablation. Conceivably, the reduction of the length of the ground electrode 4 enhances heat release from the distal-end portion of the electrode. Also, the spark plugs were mounted on a vibrator. While vibration frequency was being swept, the vibration speed of the ground electrodes was measured by use of a laser Doppler vibrometer. The measured vibration speed was subjected to frequency analysis to thereby obtain resonance frequency. As shown in FIG. 19, the sample of the present invention having the shorter electrode ground 4 exhibited higher resonance frequency, indicating that possible occurrence of vibration-induced breakage or the like is low.

Experimental Example 2

Figure 20:
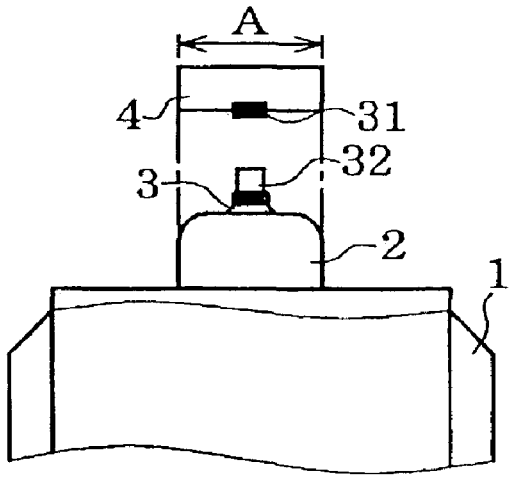
FIG. 20 is a graph showing the results of Experimental Example 2.
Figure 20:
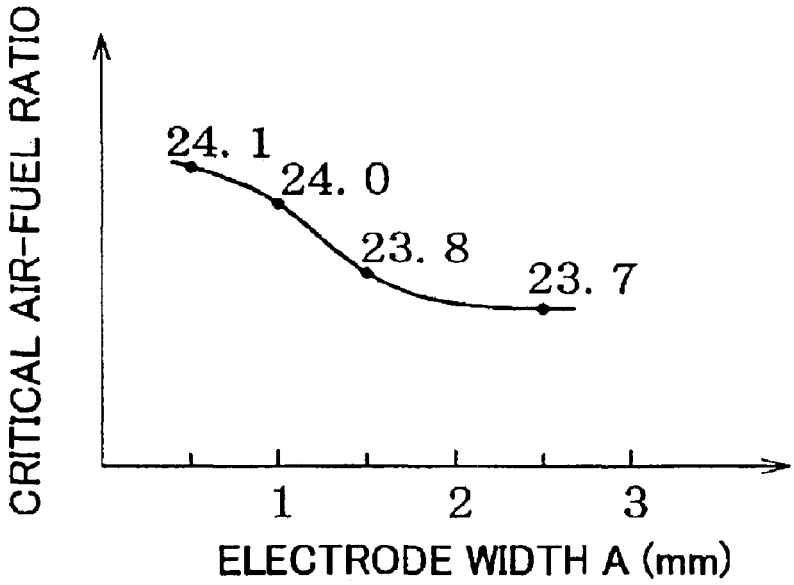

Various spark plug samples were manufactured such that the center-electrode noble-metal ablation resistance portion 31 formed from an Ir alloy had a length l of 0.8 mm and a diameter 2*r* of 0.6 mm and that x in FIG. 2 was set to 0.05 mm so as to avoid overlap. The front end surface 31*a* of the center-electrode noble-metal ablation resistance portion 31 was caused to protrude 3.5 mm from the front end surface 1*a* of the metallic shell 1. The spark discharge gap g had a gap (y) of 1.1 mm as measured along the direction of the axis O. The width of the electrode body 4*m* of the ground electrode 4 was set to various values ranging from 0.5 mm to 2.5 mm. The critical air-fuel ratio of these spark plug samples was measured in a manner similar to that of Experimental Example 1. The measured values were plotted in relation to the width of the electrode body 4*m* of the ground electrode 4. The results of plotting are shown in FIG. 20. As is apparent from FIG. 20, as the width of the electrode body 4*m* decreases, flame-extinguishing action is alleviated to a greater extent, and thus the critical air-fuel ratio increases, indicating enhancement of ignition performance. In the present experiment, the width of the entire electrode body 4*m* was reduced. However, even when, as shown in FIG. 9, only a distal end portion of the electrode body 4*m* is reduced in width, an effect similar to that of the present experiment is obtained. As is apparent from FIG. 20, particularly good results are obtained particularly when the width of a distal end portion of the electrode body 4*m* assumes a value ranging from 0.5 mm to 1.5 mm (one to three times the diameter of the center-electrode noble-metal ablation resistance portion 31).

Experimental Example 3

Various spark plug samples were manufactured such that the center-electrode noble-metal ablation resistance portion 31 formed from an Ir alloy had a radius r of 1.0 mm and a length l of 1.5 mm; x in FIG. 2 was set to 0.05 mm, −1.0 mm, and −2.5 mm; the spark discharge gap (y) was set to 0.9 mm; and other dimensions were similar to those of Experimental Example 1. The condition x<0 means that the ground electrode 4 and the front end surface of the center electrode 3 overlap each other.

Figure 18:
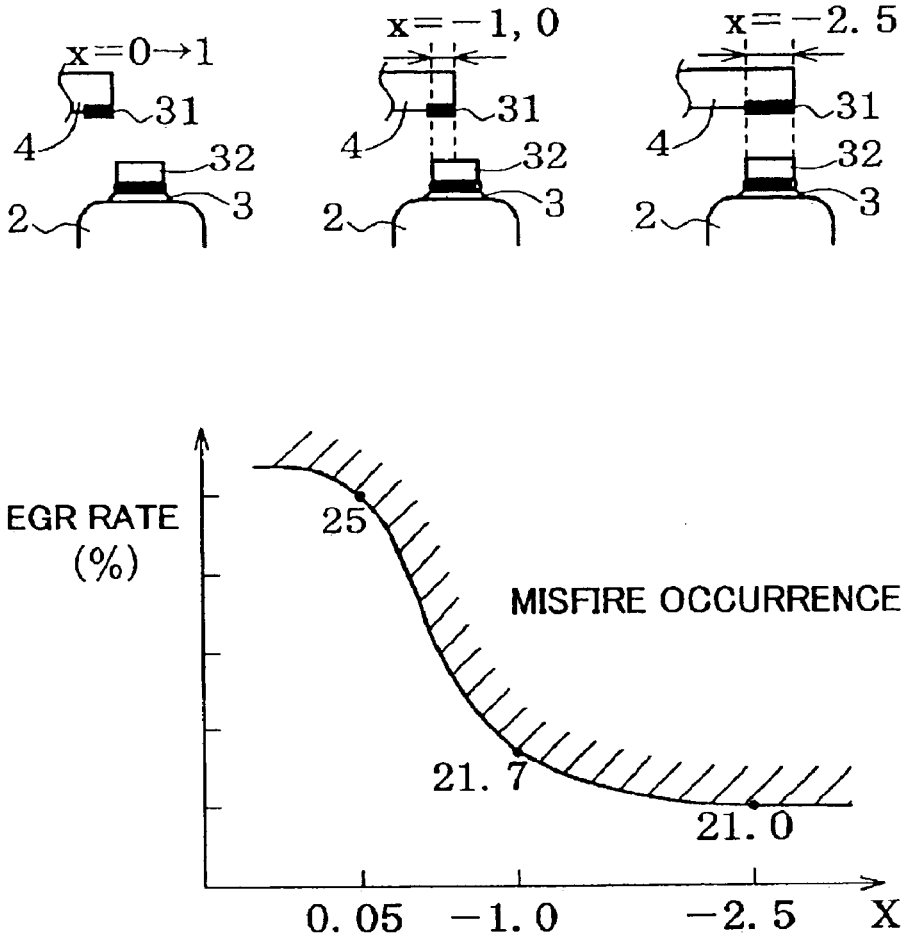
FIG. 18 is a graph showing a first group of results of Experimental Example 1.

The above-described spark plug samples were mounted on a 4-cylinder gasoline engine having a total displacement of 1,000 cc. This gasoline engine had an exhaust gas recirculation pipe which branches off from an exhaust pipe and extends to an intake manifold. The exhaust gas rate to be recirculated was adjustable. The engine was started at an engine speed of 1,500 rpm, a negative intake pressure of 290 kPa, an air-fuel ratio of intake air-fuel mixture of 16.0 (lean burn), and an exhaust gas recirculation amount of 0. Then, spark advance was gradually delayed until MBT was found. Subsequently, operation was continued with ignition timing fixed to the obtained MBT while the exhaust gas recirculation amount was being gradually increased. A time when the variation percentage of average combustion pressure on the basis of an average combustion pressure at an exhaust gas recirculation amount of 0 reached 20% was considered as a misfire occurrence limit. An exhaust gas recirculation amount as measured at the time of misfire occurrence limit was obtained as a critical exhaust gas recirculation amount. By use of this critical exhaust gas recirculation amount, the content $V_{EX}$ of $CO_2$ which is an inert gas component—in exhaust gas to be recirculated was measured by use of an exhaust gas analyzer. The $CO_2$ content $V_{IN}$ in the total mixture of intake air-fuel mixture and recirculated exhaust gas was calculated. The critical EGR rate as reduced to $CO_2$ was obtained by the equation $(V_{IN}-V_{BG})/(V_{EX}-V_{IN})$ (where $V_{BG}$ is a background $CO_2$ value displayed on the exhaust gas analyzer). As the critical EGR rate increases, misfire becomes less likely to occur even though a larger amount of inert gas is recirculated, indicating that ignition performance is enhanced. FIG. 18 is a graph showing the relationship between the critical EGR rate and the x value. As is apparent from FIG. 18, when x is in excess of 0; i.e., when the overlapping of the ground electrode and the distal end surface of the center electrode is eliminated, the critical EGR rate promptly increases, indicating that ignition performance is markedly improved.

Experimental Example 4

Spark plug samples were manufactured while being configured in a manner similar to that of Experimental Example 2 except that the radius r and length l of the center-electrode noble-metal ablation resistance portion 31 formed from an Ir alloy were set to various values shown in Table 2; x was set to 0.05 mm; and the spark discharge gap (y) was set to 1.1 mm.

TABLE 2

| | $l/r^2$ value | | |
|---|---|---|---|
| | l | | |
| 2r | 0.4 | 0.6 | 0.8 |
| 0.4 | 10 | 15 | *20 |
| 0.6 | *4.4 | 6.7 | 8.9 |
| 0.8 | *2.5 | *3.8 | 5 |

Samples marked with * fall outside the scope of the invention.

These samples were mounted on the same engine as that of Experimental Example 1. The engine was operated at an engine speed of 5,000 rpm while the throttle was completely opened, and the temperature of the center-electrode noble-metal ablation resistance portions 31 was measured by use of thermocouples. The criteria of the temperature were as follows: lower than 800° C. defective (X); 800° C. or higher but not higher than 900° C. good (B); and higher than 900° C. particularly good (A). The results are shown in Table 3.

TABLE 3

| | Temperature-Rise Test Results | | |
|---|---|---|---|
| | l | | |
| 2r | 0.4 | 0.6 | 0.8 |
| 0.4 | B | B | *A |
| 0.6 | *X | B | B |
| 0.8 | *X | *X | B |

Samples marked with * fall outside the scope of the invention.

The samples were subjected to a durability operation which was performed at an engine speed of 5,000 rpm (with the throttle fully opened) for 600 hours. Subsequently, an image of the center-electrode noble-metal ablation portion 31 of each sample was enlarged by use of a projector. From the thus-obtained enlarged images, ablated volume per unit time was calculated. The criteria of the ablated volume were as follows: $0.15\times10^{-3}$ $mm^3$/hr or less good (O); and greater than the value defective (X). The results are shown in Table 4.

TABLE 4

| | Durability Test Results | | |
|---|---|---|---|
| | l | | |
| 2r | 0.4 | 0.6 | 0.8 |
| 0.4 | ○ | ○ | *X |
| 0.6 | ○ | ○ | ○ |
| 0.8 | *○ | *○ | ○ |

Samples marked with * fall outside the scope of the invention.

As is apparent from the above-described test results, use of the center-electrode noble-metal ablation resistance portion 31 which satisfies $5\leqq l/r^2<20$ yields good performance in terms of durability and suppression of temperature rise.

Experimental Example 5

Figure 21:
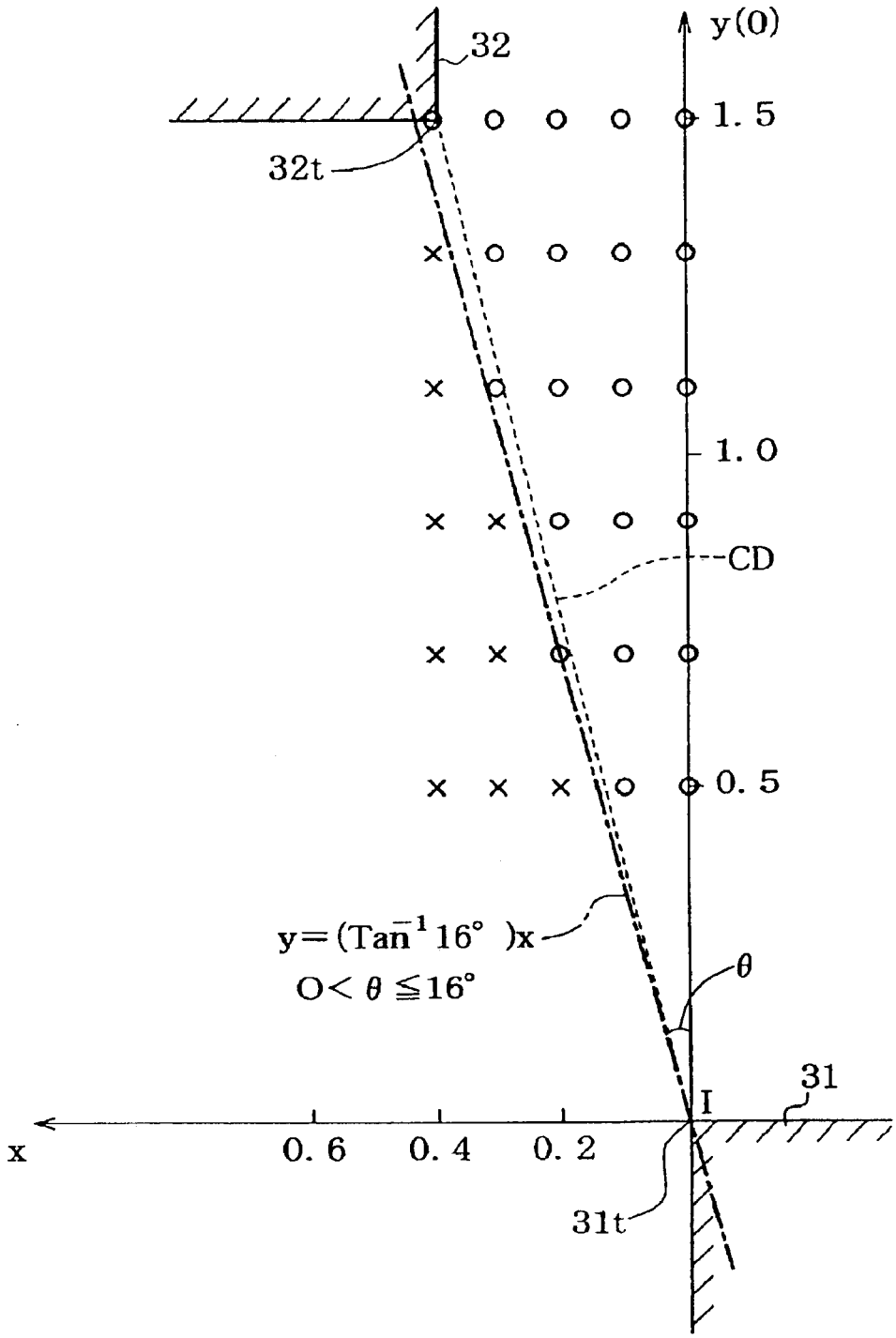
FIG. 21 is a graph showing the results of Experimental Example 5.

Spark plug samples were manufactured such that the center-electrode noble-metal ablation resistance portion 31 formed from an Ir alloy had a length l of 0.8 mm and a diameter **2*r* of 0.6 mm and that coordinates (x, y) of the rear end-edge 31*t* of the ground electrode 4 of FIG. 2 were set to various values. The front end surface 31*a* of the center-electrode noble-metal ablation resistance portion 31 was caused to protrude 3.5 mm from the front end surface 1*a* of the metallic shell 1. The width of the electrode body 4m of the ground electrode 4 was set to 2.7 mm. These spark plug samples were measured for critical air-fuel ratio in a manner similar to that of Experimental Example 1. Ignition performance of each sample having a certain gap was judged good (O) when the deviation of its critical air-fuel ratio from the best critical air-fuel ratio for the gap was within 5%, and was judged defective (X) when the deviation is greater than 5%. FIG. 21 shows the results which are mapped while being correlated with coordinates (x, y) of the rear end-edge 31*t*. As is apparent from FIG. 21**, when $1.6\geqq y\geqq 0.4$, $x>0$, and $y\geqq(\mathrm{Tan}^{-1}\ 16°)x$ are satisfied, good ignition performance is obtained.

It should further be apparent to those skilled in the art that various changes in form and detail of the invention as shown and described above may be made. It is intended that such changes be included within the spirit and scope of the claims appended hereto.

This application is based on Japanese Patent Application No. 2002-206692 filed Jul. 16, 2002, incorporated herein by reference in its entirety.

What is claimed is:

1. A spark plug comprising a tubular metallic shell, an insulator disposed in the metallic shell such that a distal end portion the insulator of protrudes from an end surface of the metallic shell, a center electrode disposed in the insulator such that a distal end portion of the center electrode protrudes from an end surface of the insulator, and a ground electrode which has a proximal end joined to the end surface of the metallic shell and a distal end portion which faces said distal end portion of the center electrode to thereby form a spark discharge gap, wherein, if a side of the spark plug toward the spark discharge gap along a direction of an axis of the center electrode is defined as a front side, a front end portion of the center electrode is formed as a circular cylindrical center-electrode noble-metal ablation resistance portion whose radius r (mm) and length l (mm) are determined so as to satisfy $5 \leqq l/r^2 < 20$;

the ground electrode is an ignition-performance-improving ground electrode in which a distal end portion thereof is bent in a direction toward the center electrode; a rear end-edge of a distal end surface of said distal end portion is located frontward in relation to a front end surface of the center-electrode noble-metal ablation resistance portion; and, in an orthogonal projection on a projection plane perpendicularly intersecting said axis of the center electrode, the rear end-edge is located outward in relation to the front end surface of the center-electrode noble-metal ablation resistance portion; and a portion of the ignition-performance-improving ground electrode which includes at least the rear end-edge is a ground-electrode noble-metal ablation resistance portion.

2. The spark plug as claimed in claim 1, wherein, when viewed in an orthogonal projection on a projection plane in parallel with a plane which includes said axis of the center electrode and a geometric barycenter position of a section of the ignition-performance-improving ground electrode cut at a position located 1 mm forward from the end surface of the metallic shell by a plane perpendicularly intersecting the axis of the center electrode, and: an origin on the projection plane is defined as the position of the closer of the two end edges of the distal end surface of the center electrode to the rear end-edge of the ignition-performance-improving ground electrode; an x-axis on the projection plane is defined as extending through the origin in parallel with the distal end surface of the center electrode such that a side corresponding to a position of the ignition-performance-improving ground electrode is positive in polarity; and a y-axis on the projection plane is defined as extending through the origin in parallel with the axis of the center electrode such that a side corresponding to a position of the spark discharge gap is positive in polarity, coordinates (x, y) (unit of length: mm) of the rear end-edge of the ignition-performance-improving ground electrode are determined so as to satisfy $$1.6 \geqq y \geqq 0.4;$$

$$x > 0; \text{ and}$$

$$y \geqq (\mathrm{Tan}^{-1} 16°)x.$$

3. The spark plug as claimed in claim 1, wherein the ignition-performance-improving ground electrode comprises an electrode body and a noble metal element which is joined to the electrode body at a position facing the spark discharge gap and serves as the ground-electrode noble-metal ablation resistance portion; and as viewed in an orthogonal projection on a projection plane in parallel with a plane which includes said axis of the center electrode and a geometric barycenter position of a section of the ignition-performance-improving ground electrode cut at a position located 1 mm forward from the end surface of the metallic shell by a plane perpendicularly intersecting the axis of the center electrode:

(a) only certain parts of the distal end surface of the ignition-performance-improving ground electrode, including the rear end-edge, are constituted by a distal end surface the noble metal element, and said distal end surface of the noble metal element protrudes toward the axis of said center electrode beyond a distal end surface formed by the electrode body which constitutes the residual portion of the distal end surface of the ignition-performance-improving ground electrode; and (b) an element surface of the noble metal element which extends from the rear end-edge toward a side corresponding to a proximal end of the ignition-performance-improving ground electrode is substantially parallel with the front end surface of the center-electrode noble-metal ablation resistance portion.

4. A spark plug comprising a center electrode, a metallic shell disposed so as to surround a circumferential side surface of the center electrode, and a ground electrode whose proximal end is joined to an end surface of the metallic shell and which forms a spark discharge gap between the metallic shell and the center electrode, wherein:

if a side of the spark plug toward the spark discharge gap along a direction of an axis of the center electrode is defined as a front side, the ground electrode is an ignition-performance-improving ground electrode in which a distal end portion thereof is bent in a direction toward the center electrode; a rear end-edge of a distal end surface of said distal end portion is located frontward in relation to a front end surface of the center-electrode noble-metal ablation resistance portion; and, in an orthogonal projection on a projection plane perpendicularly intersecting said axis of the center electrode, the rear end-edge is located outward in relation to the front end surface of the center-electrode noble-metal ablation resistance portion; and as viewed in an orthogonal projection on a projection plane in parallel with a plane which includes said axis of the center electrode and a geometric barycenter position of a section of the ignition-performance-improving ground electrode cut at a position located 1 mm forward from the end surface of the metallic shell by a plane perpendicularly intersecting the axis of the center electrode, and: an origin on the projection plane is defined as the position of the closer of the two end edges of the distal end surface of the center electrode to the rear end-edge of the ignition-performance-improving ground electrode; an x-axis on the projection plane is defined as extending through the origin in parallel with the distal end surface of the center electrode such that a side corresponding to a position of the ignition-performance-improving ground electrode is positive in polarity; and a y-axis on the projection plane is defined as extending through the origin in parallel with the axis of the center electrode such that a side corresponding to a position of the spark discharge gap is positive in polarity, coordinates (x, y) (unit of length: mm) of the rear end-edge of the ignition-performance-improving ground electrode are determined so as to satisfy $$1.6 \geqq y \geqq 0.4;$$

$$x > 0;$$

$$y \geqq (\mathrm{Tan}^{-1} 16°)x.$$

* * * * *